US010694823B2

(12) United States Patent
Aubry et al.

(10) Patent No.: US 10,694,823 B2
(45) Date of Patent: Jun. 30, 2020

(54) FOLDABLE HEAD TYPE PARASOL, AND METHOD FOR FOLDING THE HEAD OF SUCH A PARASOL

(71) Applicants: Xavier Aubry, Toulouse (FR); Cyrille Jourdain, Perpignan (FR)

(72) Inventors: Xavier Aubry, Toulouse (FR); Cyrille Jourdain, Perpignan (FR)

( * ) Notice: Subject to any disclaimer, the term of this patent is extended or adjusted under 35 U.S.C. 154(b) by 0 days.

(21) Appl. No.: 15/779,518

(22) PCT Filed: Nov. 24, 2016

(86) PCT No.: PCT/FR2016/053080
§ 371 (c)(1),
(2) Date: May 26, 2018

(87) PCT Pub. No.: WO2017/089713
PCT Pub. Date: Jun. 1, 2017

(65) Prior Publication Data

US 2018/0343994 A1 Dec. 6, 2018

(30) Foreign Application Priority Data

Nov. 26, 2015 (FR) ..... 15 61412

(51) Int. Cl.
*A45B 11/00* (2006.01)
*A45B 19/00* (2006.01)
(Continued)

(52) U.S. Cl.
CPC ..... *A45B 11/00* (2013.01); *A45B 19/00* (2013.01); *A45B 23/00* (2013.01); *A45B 25/02* (2013.01);
(Continued)

(58) Field of Classification Search
CPC . A45B 2023/0093; A45B 23/00; A45B 11/00; A45B 2011/005; A45B 19/00; A45B 2019/007; A45B 25/02
See application file for complete search history.

(56) References Cited

U.S. PATENT DOCUMENTS 2,828,758 A * 4/1958 Moro ..... A45B 23/00 135/155
2,888,021 A * 5/1959 Adams ..... A45B 23/00 135/114
(Continued)

FOREIGN PATENT DOCUMENTS

FR 2700802 A1 7/1994
WO 2005084480 A1 9/2005

*Primary Examiner* — David R Dunn
*Assistant Examiner* — Danielle Jackson
(74) *Attorney, Agent, or Firm* — Craft Chu PLLC; Andrew W. Chu

(57) ABSTRACT

The parasol includes a base having a pole, a head secured to one end of the pole and having a canvas filtering at least part of the rays of the sun, and a structure supporting the canvas and being deformable between an open configuration with the canvas outstretched, and a folded configuration with the canvas folded. The support structure includes a hoop or peripheral hoop, which is closed in on itself and lies in a plane in the open configuration. The parasol includes the canvas attached inside the peripheral hoop such that the canvas is stretched out inside the peripheral hoop in the open configuration.

9 Claims, 2 Drawing Sheets

(51) Int. Cl.
*A45B 23/00* (2006.01)
*A45B 25/02* (2006.01)

(52) U.S. Cl.
CPC ... *A45B 2011/005* (2013.01); *A45B 2019/007* (2013.01); *A45B 2023/0093* (2013.01)

(56) References Cited

U.S. PATENT DOCUMENTS

| | | | | |
|---|---|---|---|---|
| 4,312,371 | A * | 1/1982 | Koon | A45B 11/00 135/19.5 |
| 4,836,232 | A | 6/1989 | De Rosa | |
| 5,343,887 | A * | 9/1994 | Danaher | E04H 15/40 135/126 |
| 6,202,659 | B1 | 3/2001 | Sachs | |
| 6,216,711 | B1 * | 4/2001 | Ormanoski | A45B 11/00 135/16 |
| 6,260,208 | B1 * | 7/2001 | Wang | A42B 1/062 2/171.03 |
| 10,030,407 | B1 * | 7/2018 | Beedle | A45B 23/00 |
| 2001/0020484 | A1 * | 9/2001 | Ormanoski | A45B 11/00 135/117 |
| 2007/0012344 | A1 * | 1/2007 | Watts | A45B 11/00 135/20.1 |
| 2007/0283991 | A1 * | 12/2007 | Sherts | A45B 23/00 135/90 |
| 2011/0099692 | A1 | 5/2011 | Essex | |
| 2013/0284220 | A1 * | 10/2013 | Liu | A45B 11/00 135/20.1 |
| 2016/0227892 | A1 * | 8/2016 | Stewart-Stand | A45B 23/00 |
| 2017/0009482 | A1 * | 1/2017 | Remolina | E04H 15/34 |
| 2019/0029377 | A1 * | 1/2019 | Fleming | A45B 11/00 |
| 2019/0053587 | A1 * | 2/2019 | Auth | A45B 19/04 |

* cited by examiner

FOLDABLE HEAD TYPE PARASOL, AND METHOD FOR FOLDING THE HEAD OF SUCH A PARASOL

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention is related to the field of the devices for protecting against the rays of the sun and more particularly relates to a foldable head type parasol. The invention also relates to a method for folding the head of such a parasol.

2. Description of Related Art Including Information Disclosed Under 37 CFR 1.97 and 37 CFR 1.98

Among the existing devices for protecting against the rays of the sun are known parasols, i.e. the devices provided with a base intended to be fixed to the ground, and carrying a head away from the ground.

The head is typically comprised of a plurality of ribs unfolding radially about a central axis, to which is attached a canvas capable of filtering at least part of the rays of the sun when struck by said rays. The ribs are generally fastened in a hinged way, on the one hand, to the base and, on the other hand, to a sliding ring fitted on the base, capable of occupying two extreme positions. According to a first extreme position of the ring, the ribs are folded on the base, as well as the canvas, and in a second extreme position the ribs are unfolded radially around the base, exerting forces onto the canvas in order to stretch it and to confer it the shape of a spherical cap. When the canvas is stretched, it projects a shaded surface on the ground, thus forming a protection against the rays of the sun.

These parasols have namely the drawback of not being usable when the wind blows at relatively high speeds, typically a few tens of kilometers per hour, because of the large wind surface area of the canvas. By wind surface area is meant the surface on which pressure forces are exerted by the wind. These pressure forces generate force torques on the ribs. These force torques can generate mechanical stresses in the head of the parasol, and cause damage to said head due to a low resistance of the ribs to mechanical stresses. In addition, the pressure forces exerted on the canvas of the parasol can, when the pole is poorly fixed to the ground or when said forces are sufficiently important, generate a lift phenomenon displacing the parasol in the direction of the wind, posing then obvious security issues.

BRIEF SUMMARY OF THE INVENTION

According to a first aspect, the aim of the present invention is to provide a parasol capable of being used when the wind blows, without presenting problems of hazard or being deteriorated.

Another aim of the invention is to provide a parasol capable of projecting a shaded surface on the ground, fully usable by a user.

An additional aim of the present invention is to provide a parasol the use of which is simple and fast.

The present invention relates, according to a first aspect, to a parasol comprising a base including a pole and a head made integral with one end of said pole, including a canvas capable of filtering at least part of the rays of the sun and a support structure for said canvas. Said support structure is deformable between a first so-called unfolded configuration, in which the canvas is stretched, and a second so-called folded configuration, in which the canvas is folded. The support structure includes a first hoop closed in on itself, referred to as "peripheral hoop", which lies in a plane in the unfolded configuration of the support structure, and the canvas is fixed inside the peripheral hoop such that said canvas is stretched within said peripheral hoop in the unfolded configuration of the support structure. The support structure also comprises a second hoop, referred to as "inner hoop", closed in on itself, the inner hoop being arranged within the peripheral hoop, contiguous at a point of inner tangency, and substantially coplanar with the latter when the support structure is in its unfolded configuration.

When the support structure is in its unfolded configuration, the parasol is in the position of use, i.e. the canvas is capable of projecting a shaded surface on the ground.

In this unfolded configuration, the head of the parasol advantageously has a substantially flat geometric shape, capable of being placed substantially parallel to the direction of the wind. The so placed head therefore has little or no wind surface area, the pressure forces of the wind on said head are thus absent or relatively low. Because of these features of the head of the parasol, the parasol can be used when the wind blows, without exhibiting problems of hazard, or being deteriorated.

In addition, the inner hoop permits to provide mechanical strength against the forces exerted onto the support structure, namely generated by the wind in its direction.

According to particular embodiments, the invention also meets the following features, implemented separately or in each of their technically functional combinations.

In particular embodiments of the invention, the peripheral hoop is elastically deformable between a position referred to as "free position", in which it is unfolded so as to stretch the canvas, and a position referred to as "constrained position", in which it is folded on itself into a substantially flat shape.

The free position of the peripheral hoop corresponds to the unfolded configuration of the support structure, and the constrained position of said peripheral hoop corresponds to the folded configuration of the support structure.

Since the peripheral hoop is elastically deformable, once it has been deformed, it tends to recover the shape it had before deformation and generates forces to this end. The mechanical stresses, which the peripheral hoop is subjected to in the constrained position, oppose these forces so as to cancel them and maintain said hoop in the constrained position. The peripheral hoop is thus adapted to spontaneously recover its initial shape when it is no longer subjected to mechanical stresses, and hence to unfold and to stretch the canvas. Therefore, it is easy and playful to put the parasol in the position of use. In addition, the unfolding of the canvas is carried out more quickly than that of the parasols of the state of the art.

The parasol is configured so that, when the peripheral hoop is in its constrained position, said peripheral hoop is elastically deformed so as to fold the canvas on itself and to have a substantially flat shape. The parasol is then in a storage position in which it is able to be easily transported and stored.

Advantageously, the head is made integral with said end of the pole by means of a hinge system comprising a first hinge means attached to the head and a second hinge means attached to the pole, said first and second hinge means cooperating with each other.

These first and second hinge means are adapted to form a joint through which the head is capable of adopting different positions relative to the pole.

In particular embodiments of the invention, the first hinge means is arranged at the periphery of the head.

Because of this feature, when the parasol is in the position of use, the canvas is capable of projecting a shaded surface on the ground, fully usable by a user, insofar as the pole is arranged outside said shaded surface.

In particular embodiments of the invention, the first hinge means is attached to a spacer, fastened inside the inner hoop, so as to extend between two diametrically opposite points of the inner hoop.

Because of these features, the parasol is simple in design and implementation. Thus, the cost of the parasol is relatively low, and the eventual maintenance operations are facilitated, such as the replacement of parts.

In particular embodiments of the invention, the first hinge means and the second hinge means are configured so as to permit the head to be movable relative to the base in at least one degree of rotational freedom.

The hinge means are preferably configured so that the head is movable in rotation relative to the pole in a mechanical connection such as a ball-joint, in order to be able to change the orientation of the head relative to the pole along three axes of rotation.

Thus, the head can easily be arranged substantially parallel to the direction of the wind, so that it has little or no wind surface area.

The head can advantageously be detachably integral with the base, so that it can be detached from the base.

In particular embodiments of the invention, the support structure includes a third hoop closed in on itself, referred to as "intermediate hoop", arranged between the peripheral and inner hoops, fastened at a point of inner tangency of the peripheral hoop, and attached to the canvas over at least a portion of its periphery.

Advantageously, the intermediate hoop is elastically deformable between a position referred to as "free position", in which it is unfolded, and a position referred to as "constrained position", in which it is folded on itself in a substantially flat shape. The free position of the intermediate hoop corresponds to the unfolded configuration of the support structure, and the constrained position of said intermediate hoop corresponds to the folded configuration of the support structure. The intermediate hoop is substantially coplanar with the peripheral hoop.

The intermediate hoop permits to provide additional resistance against the forces exerted by the weight of the head onto the support structure, which are more or less high depending on its dimensions, and, should the case arise, by the wind onto the support structure.

In particular embodiments of the invention, the pole is of an adjustable length.

Thus, when the parasol is in its storage position, the length of the pole can be minimum, and the head is folded against the pole, so as to reduce the size of the parasol. The parasol can thus easily be transported and stored.

In particular embodiments of the invention, the pole comprises a means for securing in the ground.

The present invention relates, according to a second aspect, to a method for folding the head of a parasol comprising:

- a first step consisting in folding two opposite points of the peripheral hoop against each other, while applying a torsional force onto said peripheral hoop, so as to rotate a portion of the head by substantially one hundred and eighty degrees relative to another portion of said head,
- a second step consisting in folding the two portions of the head against each other, so as to form an intermediate arrangement in which the peripheral hoop forms two rings superimposed one against the other,
- a third step consisting in repeating the first and second steps on the so formed intermediate arrangement, so as to force the support structure into its folded configuration,
- a fourth step consisting in immobilizing the support structure in said folded configuration by a fastening means.

Preferably, when the support structure comprises an intermediate hoop and the peripheral hoop is manipulated during the implementation of the method for folding the head of the parasol, this manipulation causes deformations of the intermediate hoop substantially similar to those undergone by the peripheral hoop.

The present invention also relates to a method for unfolding the head comprising a step of releasing the support structure in which the user acts on the attachment means in order to provide the mobility to the support structure so that it spontaneously recovers its unfolded configuration.

BRIEF DESCRIPTION OF THE SEVERAL VIEWS OF THE DRAWINGS

The invention will be better understood when reading the following description, given by way of a non-restrictive example, and with reference to the figures.

DETAILED DESCRIPTION OF THE INVENTION

Figure 1:
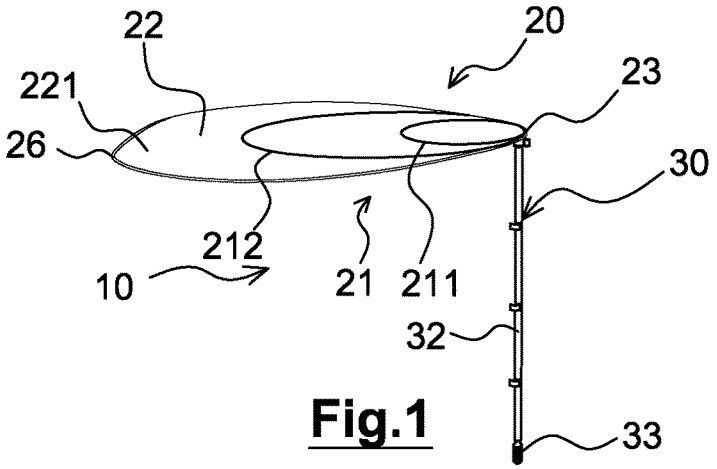
FIG. 1 is a perspective view of a parasol according to the invention, a support structure of which is in an unfolded configuration.
Figure 2:
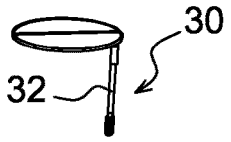
FIG. 2 is a perspective view of the parasol according to FIG. 1, the support structure of which is in a folded configuration.
Figure 3:
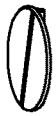
FIG. 3 is a perspective view of the parasol according to FIG. 1 in the storage position.

The present invention relates to a parasol 10, as shown in FIGS. 1 to 3, in a non-restrictive embodiment, comprising a head 20 of a parasol 10, referred to as "head" in the continuation of the text, integral with a base 30 of the parasol 10, referred to as "base" in the continuation of the text. More specifically, the base 30 includes a pole 32 extending between two opposite ends, the head 20 being integral with one of these ends.

The head 20 is formed of a support structure 21 comprising at least a first peripheral hoop 210 closed in on itself, elastically deformable. By "peripheral hoop closed in on itself" is meant that the peripheral hoop 210 has a geometric shape the contour of which is closed, as shown in FIG. 1, so as to define an inner surface area.

The peripheral hoop 210 is capable of being deformed elastically, from a so-called "free position" position to a so-called "constrained position", when it is subjected to forces of a sufficient intensity, i.e. higher than a given value. When the forces are no longer applied onto said peripheral hoop 210, or when their intensity is insufficient, i.e. lower than a given value, the peripheral hoop 210 is advantageously capable of spontaneously recovering its free position. The free position is the position occupied by the peripheral hoop 210 before deformation, i.e. a position in which it is unfolded. When it is in its unfolded position, the peripheral hoop lies in a plane.

A canvas 22 capable of filtering at least part of the rays of the sun is attached inside the peripheral hoop 210.

In a first configuration of the support structure 21, referred to as "unfolded configuration", as shown in FIG. 1, the peripheral hoop 210 is in its free position, and the canvas 22 is stretched. When the canvas 22 is stretched by the peripheral hoop 210, said peripheral hoop 210 preferably exerts tension forces onto the entire periphery of the canvas 22.

By way of an example, the peripheral hoop 210 is inserted into one or several accommodations developing along the periphery of the canvas 22. Alternatively, the peripheral hoop 210 may be permanently or attached to the canvas 22 in a removable way by any fastening means known to those skilled in the art.

The canvas 22 comprises a face 221, referred to as "upper face, which is intended to receive the rays of the sun when the parasol 10 is in the position of use, and a face 222 referred to as "lower face", which is intended to remain facing the ground when the parasol 10 is in the position of use.

The support structure 21 also comprises a second hoop 211, referred to as "inner hoop", closed in on itself so as to define an inner surface area, and attached to the canvas 22, for example against a face 221 or 222 of the canvas 22. As shown in FIG. 1, when the support structure 21 is in its unfolded configuration, the inner hoop 211 is arranged inside the peripheral hoop 210, contiguous to a point of inner tangency 23, and is substantially coplanar with the latter.

The inner hoop 211 has preferably a circular shape. The inner hoop 211 may be made of any elastically deformable material.

The support structure 21 may comprise a third hoop, referred to as "intermediate hoop" 212, arranged between the peripheral 210 and inner 211 hoops. In a way similar to the peripheral 210 and inner 211 hoops, the intermediate hoop 212 is closed in on itself, so as to form an inner surface area, and attached to the canvas 22, for example against one of its faces 221 or 222.

The intermediate hoop permits to provide additional resistance against the forces exerted by the weight of the head on the support structure, which are more or less high depending on its dimensions and, should the case arise, by the wind onto the support structure.

Advantageously, in a way similar to the peripheral hoop 210, the intermediate hoop 212 is elastically deformable between a position referred to as "free position", in which it is unfolded so as to stretch part of the canvas, and a position referred to as "constrained position", in which it is folded on itself in a substantially flat conformation.

The intermediate hoop 212 may be made of any elastically deformable material.

By way of a non-restrictive example, the surface of the inner surface area delimited by the intermediate hoop 212 is twice as large as the surface of the inner surface area delimited by the inner hoop 211.

Preferably, the hoops 210, 211 and 212 are arranged relative to each other contiguously at a point of inner tangency 23. The point of tangency 23 is referred to as "point of inner tangency" insofar as the intermediate 212 and inner 211 hoops are respectively arranged inside the peripheral hoop 210.

The peripheral hoop 210 is the hoop that is most subjected to mechanical stresses, such as the forces generated by the weight of the head and/or the forces generated by the wind. It is therefore sized so as to have a higher mechanical resistance to the intermediate 212 and inner 211 hoop. The straight cross-section of the peripheral hoop 210 has therefore larger dimensions than the straight cross-section of the intermediate hoop 212. Likewise, the intermediate hoop 212 may be sized so as to have a higher mechanical strength than the inner hoop 211, its straight cross-section may thus have larger dimensions than the dimensions of the straight cross-section of the inner hoop 211.

Figures 5, 6, 7, 8:
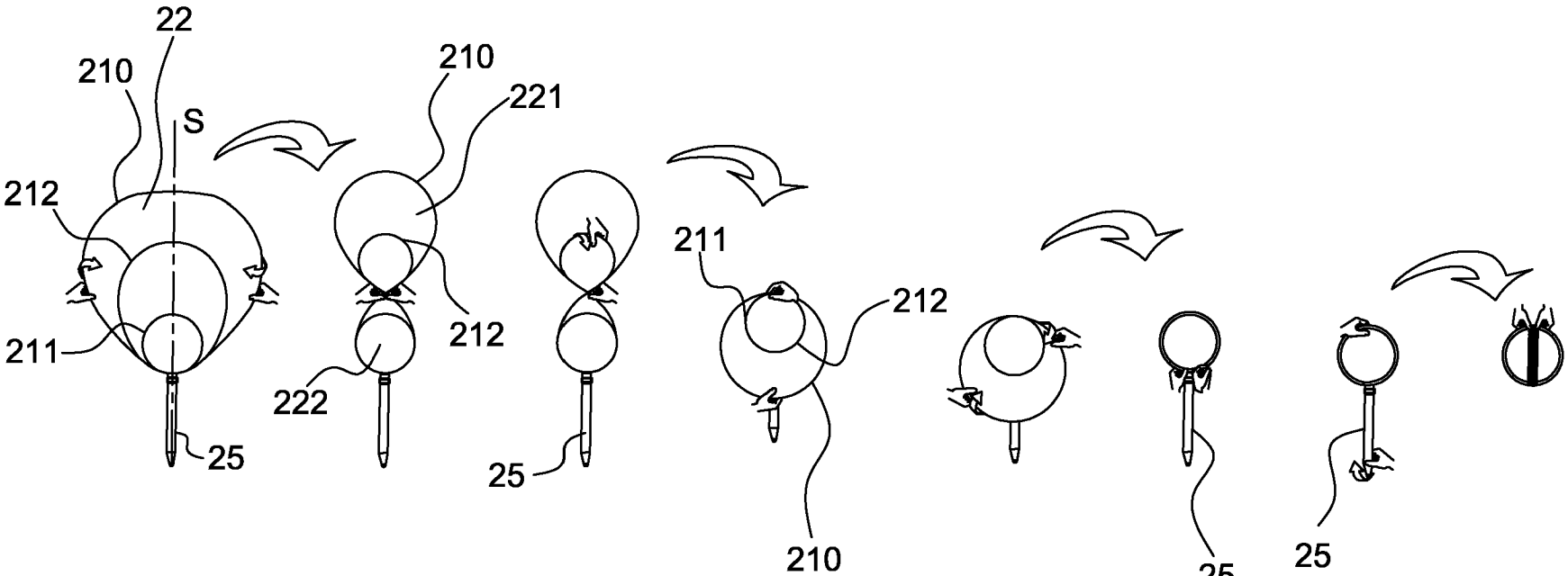
FIGS. 5 to 8 are schematic views showing successive steps of folding of the head of the parasol according to FIG. 1.

In the non-restrictive exemplary embodiment shown by FIGS. 1 and 5, the peripheral 210 and intermediate 212 hoops have substantially an ovoid geometrical shape. More specifically, said peripheral 210 and intermediate 210 hoops respectively develop in two transverse portions joined together by two longitudinal portions symmetrical with respect to an axis of symmetry S. The two transverse portions each have the geometric shape of an arc of a circle, the radii of said arcs being of values that differ from each other.

Preferably, the peripheral 210 and intermediate 212 hoops are secured to each other, at the point of inner tangency 23, by one of their transverse portions. More particularly, as shown in FIG. 1, said peripheral 210 and intermediate 212 hoops are secured at the point of inner tangency 23 by their respective transverse portion the value of the radius of which is the smallest.

The head 20 is made integral with the pole 32 by a hinge system 24. Advantageously, the hinge system 24 can be fastened at the periphery of the peripheral hoop 210.

The hinge system 24 comprises a first hinge means 243 fastened to the head 20 and a second hinge means 31 fastened to the pole 32.

The first hinge means 243 is fastened to a spacer 240 secured inside the inner hoop 211 so as to connect two diametrically opposite points of the inner hoop 211.

The spacer 240 extends along a longitudinal axis, and comprises two opposite ends each comprising respectively an end face. Each end face advantageously comprises a notch 241, 242 intended to receive a portion of the inner hoop 211.

In the exemplary embodiment shown in FIGS. 1 and 5, the spacer 240 is adjacent to the point of inner tangency 23 of the inner 211, intermediate 212 and peripheral 210 hoops, by one of its ends referred to as "proximal end", its other end, referred to as "distal end" being spaced apart from said point of inner tangency 23, therefore the pole 32 is eccentric with respect to the head 20.

Alternatively, the spacer 240 may be non-adjacent to the point of inner tangency 23.

Figure 4:
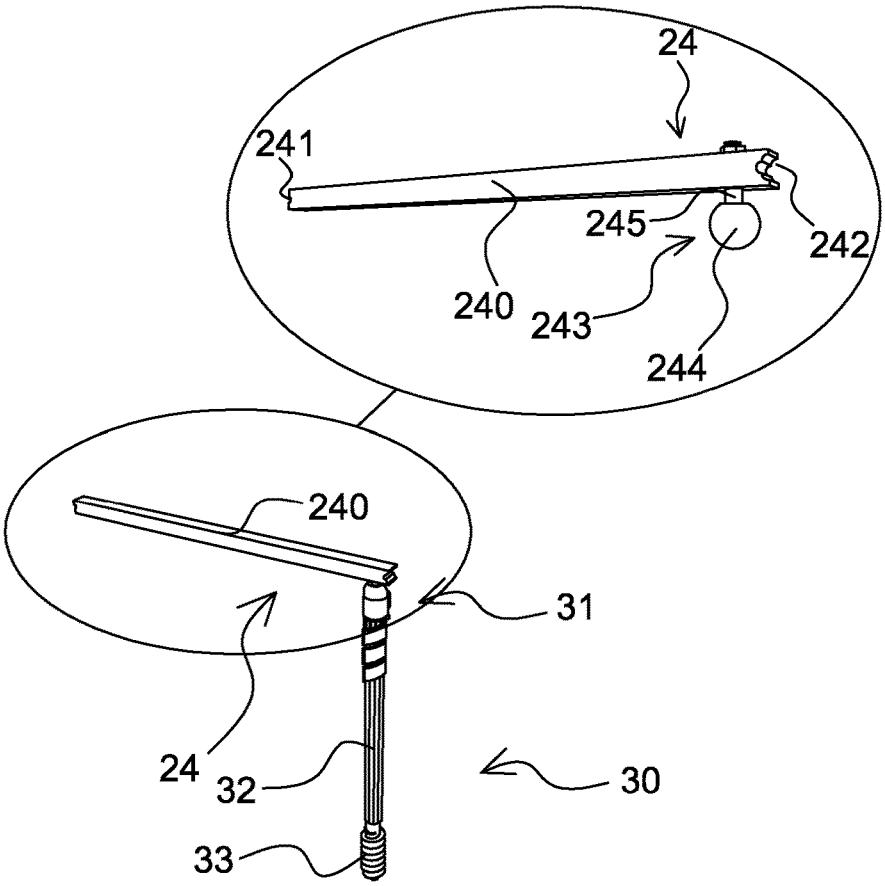
FIG. 4 is a perspective view of a spacer attached in a hinging way to the base of the parasol according to FIG. 1, and a detail view of a hinge system of the head of the parasol at the base of the parasol attached to said spacer.

In the exemplary embodiment shown by the detail view of FIG. 4, the notch 242 formed on the face of the proximal end of the spacer 240 comprises several impressions so as to successively receive, juxtaposed to each other, the inner hoop 211, the intermediate hoop 212 and the peripheral hoop 210. The impressions are dimensioned so as to correspond to the dimensions of the straight cross-sections of the peripheral 210, intermediate 212 and internal 211 hoops.

The notch 241 made on the face of the distal end preferably comprises only one impression insofar as it is intended to receive only the inner hoop 211.

Alternatively, in other embodiments, not shown in the figures, the notches 241, 242 of the end faces may each comprise only one impression.

Advantageously, the spacer 240 and the inner hoop 211 are mechanically linked by a tight adjustment, brought about for example by a slight deformation of the inner hoop 211, generating a holding tension of the spacer 240. Alternatively, the spacer 240 may be mechanically linked to the inner hoop 211 by any other fastening means known per se.

Preferably, the second hinge means 31 is located at one of the ends of the pole 32, referred to as "upper end".

As shown by FIG. 4 by way of a non-restrictive example, the first hinge means 243 may comprise a sphere 244.

Preferably, the sphere 244 is maintained at a distance from the spacer 240 through a shaft 245 the longitudinal axis of which extends, for example, perpendicularly to the longitudinal axis of the spacer 240, such as shown by the detail view of FIG. 4.

Preferably, the shaft 245 is arranged in the vicinity of the proximal end of the spacer 240. The spacer 240, the shaft 245 and the sphere 244 can be obtained as a single part, by molding.

However, alternatively, the shaft 245 may be attached to the spacer 240 by a screw/nut assembling or by any known assembling means, and the sphere 244 can be permanently fastened to the shaft 245, for example by gluing.

The second hinge means 31 is intended to cooperate with the first hinge means 243, so that the head 20 is capable of being movable relative to the base 30 according to at least one degree of rotational freedom.

In other exemplary embodiments, not shown in the figures, the first and second hinge means 243, 31 may together form a mechanical link such as a pivot or a mechanical link having two degrees of rotational freedom.

Preferably, the hinge system 24 permits the hinging of the head 20 relative to the base 30 according to a mechanical connection such as a ball-joint.

Preferably, the second hinge means 31 comprises an accommodation having a shape complementary to the sphere 244, so that said sphere 244 is capable of pivoting in the accommodation according to at least one axis of rotation.

The second hinge means 31 also comprises means for locking said sphere 244 in rotation. For example, the accommodation is provided with a clamping organ capable of deforming said accommodation, within the limits of its elastic limit, so as to apply a clamping force onto the sphere 244 that is sufficient to lock said sphere 244 in rotation.

In a non-restrictive exemplary embodiment, the head is integral with the base in a removable way, so that it can be detached from the pole. Thus, a user can in particular use heads of different dimensions with a single base.

As shown in FIGS. 1 and 4, the pole 32 is provided, at its other end, referred to as "lower end", with a means for fixing 33 in the ground.

Advantageously, the means for fixing 33 in the ground consists of an outer thread on a portion of the length of the pole 32, the straight cross-section of which decreases towards the lower end of the pole 32. Thus, the parasol 10 can be screwed into the soft ground or into any suitable accommodation, so as to perform a screw/nut assembling.

Alternatively, the fixing means 33 may be formed by any arrangement or device known to those skilled in the art, such as the shaping of the lower tip-shaped end.

Advantageously, the length of the pole 32 can be adjustable between two extreme, minimum and maximum, lengths respectively represented by FIGS. 1 and 4.

To this end, the pole 32 can be telescopic, so that it can be divided into at least two coaxial portions fitted one inside the other and capable of sliding relative to each other.

The pole 32 then comprises means for stopping the translation of the portions relative to each other. For example, one of the portions is provided with a clamping organ capable of deforming said portion so as to apply a clamping force to the other portion sufficient in order to block the portions in translation.

In the non-restrictive exemplary embodiment shown in FIGS. 1 to 4, the pole 32 is divided into four portions, three of which are provided with clamping organs.

Alternatively, in other exemplary embodiments, not shown in the figures, the portions of the pole 32 may be attached to each other in a hinging way, so as to respectively occupy a folded position, in which they are adjacent to each other, over their entire length, and an unfolded position, in which they are coaxial and adjacent to each other by each of their ends.

The parasol 10 may advantageously occupy a position of use, in which the support structure 21 is in its unfolded configuration, as shown in FIG. 1, the canvas 22 being unfolded.

In this position, the canvas 22 is unfolded and is intended to project a shaded surface on the ground, when it is struck by the rays of the sun, in order to provide a protection for a user against said rays.

FIG. 3 shows the parasol 10 in the storage position, the support structure 21 being in a second configuration, referred to as "folded configuration" and the pole 32 being adjusted so that its length is minimum. In this folded configuration of the support structure 21, the peripheral hoop 210 and the intermediate hoop 212 are elastically deformed, in the stressed position, so as to fold the canvas 22 on itself, as described more specifically in the continuation of the text.

In this position, the parasol 10 is intended to be transported or stored.

In order to change the position of the parasol 10, from a position of use to a storage position, the user must perform steps in order to bring the support structure 21 into the folded configuration. FIGS. 5 to 8 respectively show an exemplary embodiment of the successive steps of a method for folding the head 20 according to the invention.

FIG. 5 shows a first step consisting in folding against each other one point of each longitudinal portion of the peripheral hoop 210. The points are preferably chosen so that their projection orthogonal to the axis of symmetry S passes through the inner surface area defined by the intermediate hoop 212, and are preferably substantially symmetrical to each other along the axis of symmetry S.

At the same time, a torsional force is applied to the peripheral hoop 210 so that respective portions of the upper 221 and lower 222 faces of the canvas 22 simultaneously appear in the same plane. A portion of the head 20 is thus pivoted, substantially over one hundred and eighty degrees with respect to another portion of said head (20). These two portions correspond respectively to each of the upper 221 and lower 222 faces of the canvas 22. The head then adopts substantially the form of a lemniscate.

It should be noted that the manipulation of the peripheral hoop by the user, during the implementation of the method for folding, causes deformations of the intermediate hoop substantially similar to those undergone by the peripheral hoop.

In a second step, the two portions of the head 20 are then folded against each other, so that the portions of the upper 221 and lower 222 faces are arranged opposite each other, as shown in FIG. 6. An intermediate arrangement is thus formed, in which the peripheral hoop 210, as it is deformed due to these steps, forms two rings superimposed against each other, as well as the intermediate hoop 212.

Preferably, but not restrictively, the hoops 210, 211 and 212 are manipulated so that the intermediate hoop 212 is substantially concentric with the inner hoop 211 and that their diameter is substantially identical.

A third step consists in repeating the first and second steps carried out above, the two points to be folded against each other being two diametrically opposite points of the peripheral hoop 210, as shown in FIG. 7. The head 20 then has a disk shape the diameter of which is substantially equal to the diameter of the inner hoop 211, formed by a superposition of hoop portions.

It should be noted that when the peripheral 210 and intermediate 212 hoops are in the stress position, they exert tension forces to the extent that said peripheral 210 and intermediate 212 hoops try to recover their free position, i.e. their initial unfolded form.

FIG. 8 shows a fourth step consisting in immobilizing the support structure 21 in its folded configuration resulting from the previous folding steps. Indeed, it is necessary to immobilize the peripheral 210 and intermediate 212 hoops in order to maintain this shape. This step of immobilizing the support structure 21 is performed by an attachment means 25 opposing the tension forces exerted by the peripheral 210 and intermediate 212 hoops aimed at bringing them back into the free position.

As shown in FIG. 8 in a non-restrictive exemplary embodiment, the attachment means 25 comprises a strap fastened at the periphery of the head 20, intended to be arranged on both sides of the head 20 so that it diametrically surrounds said head 20. The strap can be fastened at one of its ends to the point of inner tangency 23 of the hoops 210, 211 and 212, and may include means for removably securing the strap on itself at an attachment point.

Preferably, the head 20 has reference means permitting a user to determine the position of the points of the peripheral hoop 210 to be folded against each other during at least one of the steps described above These reference means may be colored marks attached, for example, on the accommodation or accommodations developing along the periphery of the canvas 22.

It should be noted that the material the peripheral 210 and intermediate 212 hoops are made of, as well as their dimensions, are determined so that said hoops do not deform beyond their elastic limit during the steps of folding of the head 20. In this respect, the deformation of these peripheral 210 and intermediate 212 hoops is always reversible.

In order to change the position of the parasol 10, from a storage position to a position of use, the unfolding of the head 20 is performed without any intervention by the user other than the one consisting in releasing said support structure 21 from the attachment means 25.

Indeed, the tension forces exerted by the peripheral 210 and intermediate 212 hoops tend to spontaneously restore the support structure into the unfolded configuration.

In other exemplary embodiments of the invention, the material the peripheral hoop 210 is made of, as well as the dimensions of its straight cross-section and the inner surface area that it defines, are such that it has a sufficiently high rigidity to maintain the head 20 in a substantially flat shape when the support structure 21 is unfolded, without an intermediate hoop 212. It is up to those skilled in the art, based on their general knowledge, to make such an adequate choice of material and dimensions of the peripheral hoop 210.

More generally, the scope of the present invention is not limited to the embodiment described above by way of a non-restrictive example, but extends on the contrary to all modifications within the reach of those skilled in the art.

What is claimed:

1. A parasol, comprising:

a base being comprised of a pole; and a head being integral with one end of said pole, wherein said head comprises a support structure attached to said one end of said pole; and a canvas secured to said support structure, wherein said support structure comprises:

a peripheral hoop being deformable and having a point of inner tangency, said canvas being secured to said peripheral hoop;

an inner hoop being deformable, being arranged inside said peripheral hoop, and being contiguous at said point of inner tangency; and an intermediate hoop being deformable, being arranged inside said peripheral hoop and outside said inner hoop, and being contiguous at said point of inner tangency with said peripheral hoop and said inner hoop, wherein said support structure has an unfolded configuration, said canvas being stretched by said peripheral hoop in said unfolded configuration so as to define a plane with an upper face and a lower face opposite said upper face, said intermediate hoop being coplanar with said peripheral hoop in said unfolded configuration, said inner hoop being coplanar with said intermediate hoop and said peripheral hoop in said unfolded configuration, and wherein said support structure has a folded configuration, said canvas being folded, said intermediate hoop being folded when said peripheral hoop is folded.

2. The parasol, according to claim 1, wherein said peripheral hoop is elastically deformable, said peripheral hoop having a free position corresponding to being unfolded and said unfolded configuration of said support structure, and a constrained position corresponding to said upper face being folded on said lower face in a flat conformation and said folded configuration of said support structure, and wherein said intermediate hoop is elastically deformable, said intermediate hoop having a free intermediate position corresponding to being unfolded and said unfolded configuration of said support structure, and a constrained intermediate position corresponding to an upper intermediate face of said intermediate hoop being folded on a lower intermediate face of said intermediate hoop in a flat conformation and said folded configuration of said support structure.

3. The parasol, according to claim 1, further comprising: a hinge system, wherein said hinge system comprises:

a first hinge means fastened to said head; and a second hinge means fastened to said pole, said first hinge means and said second hinge means cooperating with each other so as to make said head integral with said one end of said pole.

4. The parasol, according to claim 3, wherein said first hinge means is arranged at a periphery of said head.

5. The parasol, according to claim 3, wherein said head is movable relative to said pole according to at least one degree of rotational freedom.

6. The parasol, according to claim 3, further comprising: a spacer secured inside said inner hoop, said spacer extending between two diametrically opposite points of said inner hoop, said first hinge means being attached to said spacer.

7. The parasol, according to claim 1, wherein said pole has an adjustable length.

8. The parasol, according to claim 1, wherein said pole further comprises: a means for securing.

9. A method for folding, comprising the steps of:

assembling said parasol with said support structure in said unfolded configuration according to claim 1;

folding two opposite points of said peripheral hoop against each other, while applying a torsional force onto said peripheral hoop, so as to rotate a portion of said head by one hundred and eighty degrees relative to another portion of said head;

folding said portion of said head and said another portion of said head so as to form an intermediate arrangement comprised of said peripheral hoop in two superimposed rings;

folding two opposite points of said intermediate arrangement, while applying another torsional force onto said intermediate arrangement, so as to rotate a portion of said two superimposed rings by one hundred and eighty degrees relative to another portion of said two superimposed rings;

folding said portion of said two superimposed rings and said another portion of said two superimposed rings so as to force said support structure into said folded configuration; and immobilizing said support structure in said folded configuration by a fastening means.

* * * * *